US007063381B2

(12) United States Patent
Scahill et al.

(10) Patent No.: US 7,063,381 B2
(45) Date of Patent: Jun. 20, 2006

(54) FURNITURE AND CLOTHING SUPPORT/HANGING ARRANGEMENT

(75) Inventors: Patrick Joseph Scahill, c/o Pipers, Level 1, 29 Waterloo Road, Lower Hutt (NZ); Stephen James Garlick, c/o Pipers, Level 1, 29 Waterloo Road, Lower Hutt (NZ)

(73) Assignees: Stephen James Garlick (NZ); Michael John Garlick (NZ); Patrick Joseph Scahill (NZ); John Anthony Dowsett (NZ)

( * ) Notice: Subject to any disclaimer, the term of this patent is extended or adjusted under 35 U.S.C. 154(b) by 53 days.

(21) Appl. No.: 10/501,977

(22) PCT Filed: Oct. 10, 2002

(86) PCT No.: PCT/NZ02/00209

§ 371 (c)(1),
(2), (4) Date: Jul. 15, 2004

(87) PCT Pub. No.: WO03/059124

PCT Pub. Date: Jul. 24, 2003

(65) Prior Publication Data

US 2005/0225129 A1 Oct. 13, 2005

(30) Foreign Application Priority Data

Jan. 18, 2002 (NZ) ..... 516708

(51) Int. Cl.
*A47C 7/64* (2006.01)
*B60R 7/00* (2006.01)
*A47F 1/00* (2006.01)

(52) U.S. Cl. ..... 297/188.03; 297/188.04; 297/188.07; 224/275; 248/295.11; 248/286.1

(58) Field of Classification Search ..... 297/188.03, 297/188.04, 188.06, 188.07; 224/275; 248/295.11, 248/286.1
See application file for complete search history.

(56) References Cited

U.S. PATENT DOCUMENTS

| | | | | | |
|---|---|---|---|---|---|
| 727,119 | A | * | 5/1903 | Farish | 297/188.03 |
| 846,910 | A | * | 3/1907 | Crump | 297/188.03 |
| 859,494 | A | * | 7/1907 | Hardesty | 297/188.03 X |
| 1,250,857 | A | * | 12/1917 | Griggs | 297/188.03 X |
| 1,290,698 | A | * | 1/1919 | Bass | 297/188.03 |
| 1,473,702 | A | * | 11/1923 | Guthridge et al. | 297/188.03 X |
| 1,722,122 | A | * | 7/1929 | Wilson | 224/275 X |
| 1,767,708 | A | * | 6/1930 | Simpson | 297/188.03 |
| 1,888,253 | A | * | 11/1932 | Adler | 224/275 X |

(Continued)

FOREIGN PATENT DOCUMENTS

EP 970640 1/2000

(Continued)

*Primary Examiner*—Rodney B. White
(74) *Attorney, Agent, or Firm*—Arnold B. Silverman; Lee Kim; Eckert Seamans Cherin & Mellott, LLC

(57) ABSTRACT

A garment support assembly which is adapted to be fitted to a backrest of a seat is described. The seat backrest includes a rear face and a forward face against which a user's back can rest when seated. The assembly includes a support movable between a first stowed non-usable position within the rear face of the backrest and a second usable position projecting from the backrest. The assembly is adapted when in use to support a garment, preferably a jacket sports coat or similar.

13 Claims, 4 Drawing Sheets

U.S. PATENT DOCUMENTS

| | | | | | |
|---|---|---|---|---|---|
| 2,033,520 | A | * | 3/1936 | Gubitz | 297/188.03 |
| 2,051,265 | A | * | 8/1936 | Martin | 224/275 X |
| 2,173,569 | A | * | 9/1939 | Troendle | 224/275 X |
| 2,255,973 | A | * | 9/1941 | Hoobler | 297/188.03 X |
| 2,262,581 | A | | 11/1941 | Gonczy | |
| D156,691 | S | * | 1/1950 | Belmont | D6/343 |
| 2,591,381 | A | * | 4/1952 | Scott-Dalgleish | 297/188.03 |
| 2,692,688 | A | * | 10/1954 | Callais | 297/188.03 X |
| D173,386 | S | * | 11/1954 | Ryan | D6/343 |
| 2,951,531 | A | * | 9/1960 | Dantes | 297/188.07 X |
| 3,100,128 | A | * | 8/1963 | Gleitsman et al. | 297/188.03 |
| 3,149,879 | A | | 9/1964 | Steiber | |
| 3,189,380 | A | * | 6/1965 | Reguitti | 297/188.03 |
| 4,711,488 | A | | 12/1987 | Ohanessian | |
| 4,957,230 | A | | 9/1990 | Gonzales | |
| 5,058,790 | A | * | 10/1991 | LaVelle | 224/275 |
| 5,383,588 | A | * | 1/1995 | Kazel | 224/275 |
| 5,947,033 | A | * | 9/1999 | Lombardo | 297/188.04 X |
| 6,126,235 | A | * | 10/2000 | Grove | 297/188.03 X |
| 6,260,750 | B1 | * | 7/2001 | Chiang | 224/275 |
| 6,443,523 | B1 | | 9/2002 | Reitze | |
| 6,808,093 | B1 | * | 10/2004 | Lin et al. | 297/188.03 X |
| 2003/0184134 | A1 | * | 10/2003 | Liu | 297/188.03 |
| 2005/0224540 | A1 | * | 10/2005 | Chen | 224/275 |

FOREIGN PATENT DOCUMENTS

| | | | | | |
|---|---|---|---|---|---|
| JP | 08-150043 | | | 6/1996 | |
| JP | 08-228887 | | | 9/1996 | |
| JP | 08-243005 | | | 9/1996 | |
| JP | 11-155690 | | | 6/1999 | |
| JP | 2000-262352 | | | 9/2000 | |
| JP | 2001-145541 | | | 5/2001 | |
| JP | 2001-190357 | | | 7/2001 | |
| WO | WO 9108928 | A1 | * | 6/1991 | 224/275 |
| WO | WO 9325411 | A1 | * | 12/1993 | 224/275 |
| WO | WO 03/059124 | A1 | | 7/2003 | |

* cited by examiner

FURNITURE AND CLOTHING SUPPORT/HANGING ARRANGEMENT

CROSS-REFERENCE TO RELATED APPLICATION

This application is a national phase entry of PCT Application No. PCT/NZ02/00209, filed Oct. 10, 2002.

FIELD OF INVENTION & BACKGROUND

This invention relates to furniture and clothing support/hanging arrangements. The invention is particularly applicable to, but not confined to, seating arrangements for such as meetings, convention assemblies, seminars and the like and to the problems faced by attendees in finding a convenient place to hang garments such as a jacket or coat.

It is commonplace for attendees to arrive at such as business meetings/gatherings formally or semi-formally dressed with a jacket. At some stage after arrival it is likely that the attendee will wish to remove his/her jacket for comfort. Meeting rooms are notoriously warm and stuffy environments, not sympathetic to jacket wearers. At the same time attendees will wish to keep their jackets close by for security and quick access to pocket contents etc. It is often the case that jackets may be required to be placed back on as temperatures cool.—it is a well known source of discomfort to find significant temperature fluctuations in such as large hotel meeting and convention centre rooms, due to the varying operation of air conditioning systems for large areas. Typically an attendee will (or will endeavour to) hang his or her jacket over his/her seat backrest, but this can be a problem in many instances and usually has a number of disadvantages, including for example:

a. a problem in keeping the jacket in place on a backrest having rounded upper edge parts;
b. collar and label rumpling and/or jacket dislodgment with back pressure from and movement by the seated person;
c. the lower edge parts of the jacket resting on or brushing the floor and becoming dirtied, particularly when the jacket is simply hooked from the neck or collar part at one corner of or a projection on the backrest; and
d. distortion and possible damage to the jacket by improper support and non-conforming shape of the seat backrest upper edge parts, particularly with back pressure and movement as aforesaid.

ADVANTAGES

The present invention affords the following advantages:
provides support for garments when hung
maintains garment shape when hung
prevents distortion of garments resulting from being hung
prevents garments from becoming dirtied
generally maintains the integrity of garments when hung
provides for ease of fitment of new and existing chairs
provides for ease of maintenance and/or refurbishment of existing chairs
provides the public with a useful choice.

OBJECTS OF THE INVENTION

An object of the invention is provide a means for overcoming the aforementioned problems and disadvantages arising from use of conventional seat backrests to temporarily support a garment such as a jacket of a meeting attendee; and to provide a convenient and effective garment support means whereby a jacket or like garment can be positively and safely hung in a manner guarding against accidental lodgment and in a manner providing against distortion of the garment shape.

The invention is not of course limited to use for the support of the jacket of an attendee at a meeting, and it is another object of the invention to provide a combination seat backrest and garment support hanger assembly that may be very usefully applicable in the furnishing of such as a small room (eg a small hotel or other bedroom, bed-sitter accommodation, a study or home office) where wardrobe and garment hanging space may be at a premium, and in such as commercial office situations and in restaurants or the like.

Other and more particular objects and advantages of the invention will become apparent from the ensuing description.

DEFINITIONS

Throughout the specification the term "garment" will be used to describe any garment such as a coat, jacket or the like for which it is desirable to lay or rest on the back of a seat or chair.

Throughout the specification the term "backrest" is to used to describe the upright portion of a seat or chair having a front and back face, the front face being the point of contact with a user when seated. The front face may be padded, cushioned, lined or clad. The back face is usually constructed of stiff, supportive material.

SUMMARY OF INVENTION

In a first aspect the invention may be said to broadly comprise a coat or like garment support hanger assembly fitted or arranged for fitment to a seat backrest and having a garment support part movable between a first stowed non-usable position within or in close proximity to the rear part of a seat backrest, and a second usable position projecting from the seat backrest for support of a coat or like garment.

In a second aspect of the invention there is provided a seat backrest assembly arranged for fitment to a rear upper support part of a seat, said backrest assembly having an upright forward face against which a users back can rest when seated, and a rear face incorporating or provided with a coat or like garment support hanger mounted for movement between a first inner stowed and/or non-usable position and a second projecting position enabling a garment to be located and supported thereon.

The support hanger is shaped to provide good form fitting support across and between the shoulder parts of a garment such as a jacket, for maintenance of the garment shape whilst supported thereon, and in one preferred form thus comprises a medial support part with an upper projecting shaped neck portion and opposite laterally projecting wing parts merging therewith and defining garment shoulder support parts. A simpler lower cost version may omit the shaped neck portion.

Prefereably, the upper projecting neck portion is manoeuvrable in a telescopic-like fashion.

Preferably the seat backrest is recessed on its rear side to enable location of said garment support hanger within such backrest recess when in the first stowed non-usable position; but in the alternative and again providing a lower cost version, the garment support hanger and mounting arrangement therefor may provide that in the stowed position the support hanger lies in juxtaposition with the rear side of the seat backrest.

Preferably also said garment support hanger locates in raised projecting relationship with the backrest when in the second position for support of a jacket or lice garment in an elevated position with the lower edge portions of the garment clear of the floor on which the seat is located.

The invention includes a garment support hanger assembly adapted for fitment to a backrest of an existing seat or chair; a combination backrest fitted with or incorporating a garment support hanger assembly, the assembly as a whole being adapted and arranged as a replacement assembly for the conventional backrest of an existing seat or chair; and a complete seat unit or chair incorporating the combination garment support hanger assembly and seat backrest.

Preferably the constructions in accordance with the invention include releasable retaining means for holding the garment support hanger assembly securely in said first stowed and second usable positions.

Other aspects of the invention are outlined in the following description.

BRIEF DESCRIPTION OF DRAWINGS

Some preferred forms or aspects of the invention will now be described by way of example and with reference to the accompanying drawings, in which.

DESCRIPTION OF INVENTION

Figure 1:
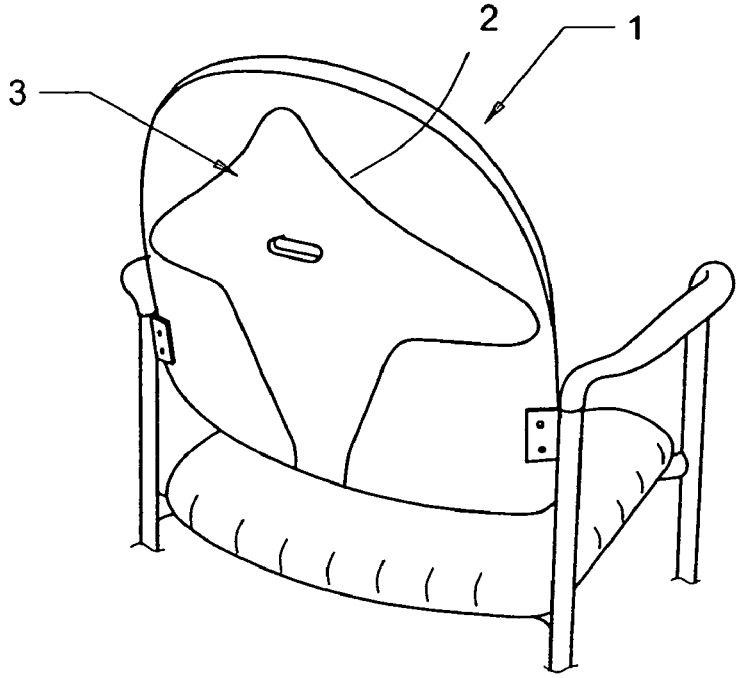
FIG. 1 is a rear perspective view of one preferred form of combination chair or seat back and garment support hanger assembly, shown in the first stored position.
Figure 2:
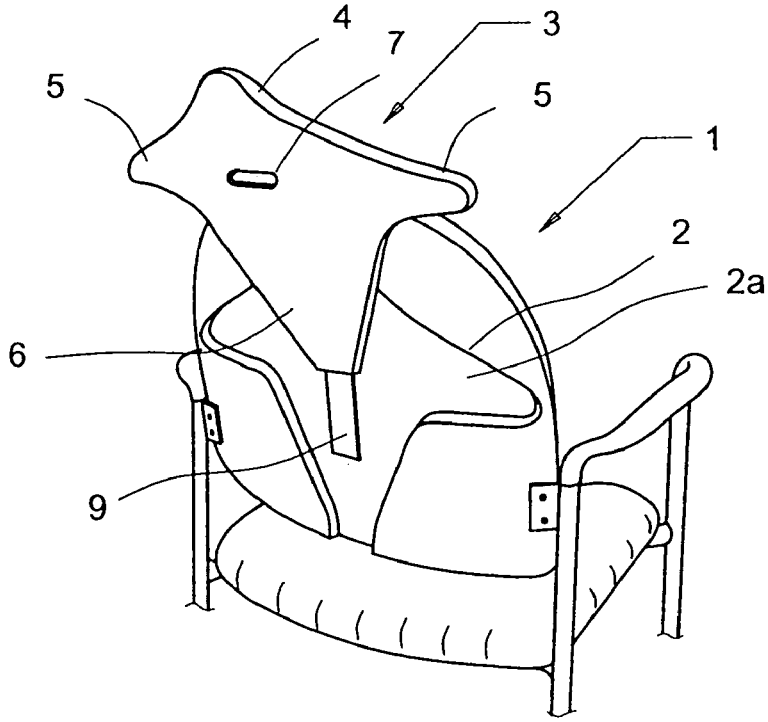
FIG. 2 is a rear perspective view of the assembly similar to FIG. 1 but illustrating the garment support hanger in the second elevated and projecting position ready for use.

In the first preferred form of the invention and as illustrated in FIGS. 1 to 5 inclusive, the seat or chair backrest 1 has a recess 2 on the rear side and conforming in depth and shape to the thickness and shape of the garment support hanger part, generally indicated by the arrow 3, of the assembly; to thus enable the full stored or stowed location of the support hanger part 3 within such recess 2 when in the first position not required for use in supporting a jacket or like garment. The rear surface of the support hanger part 3 is preferably contoured to suit and arranged to lie flush with, or substantially so, the main rear surface of the seat backrest 1 surrounding the recess 2; so that the support hanger part 3 is unobtrusive when in the first stored position and the aesthetic lines of the seat or chair as a whole are unaffected. This arrangement of backrest 1 and recessed garment support hanger 3 provision is also particularly advantageous for application to stackable chair units, as are commonly preferred for use in such as meeting rooms and restaurants or like places where large and varying numbers of people are required to be accommodated and the chairs are required to be frequently relocated and/or stored when not in use.

The seat backrest 1 to which the invention applies or can be applied can be of any convenient or required shape and be constructed from any suitable conventionally used material or combination of materials applicable to chair manufacture. As indicated the invention has a particularly useful application to stackable chairs for use in meeting rooms, restaurants and the like and the accompanying drawing example such a chair with a slim rounded backrest 1 which may be conveniently formed as a recessed solid article from such as by moulding from a suitable rigid and aesthetically pleasing and pre-coloured plastics material, and the support hanger part 3 similarly formed by moulding from the same plastics material. Alternatively the rear surface part of the backrest can be formed such as by stamping and pressing into the desired shape and recessed form from such as a sheet metal or strong rigid sheet plastics material; and the backrest 1 completed with an overlying hard front pad or cushioned front pad or covering. The latter construction can thus enable the application of the invention to other than stackable chair units and for example enable application to larger and/or more luxurious executive office and custom built chairs, or chairs more suited to hotel bedroom or sitting rooms and uses other than meeting room use. The combination seat backrest 1 and garment support hanger 3 assemblies can be formed in a variety of peripheral shapes and sizes so as to be employed in the manufacture of new chairs or provided separately as alternative or replacement backrest components for currently manufactured and available stackable and/or non-stackable chairs having separately formed detachable backrest components.

It is envisaged that the backrest may comprise the support hanger and is adapted to be attached to the front portion of a chair or seat by means of a screw-on, clip-on or snap fit arrangement. Thus the backrest assembly, preferably comprising the support hanger may be readily and easily attached to existing seats or chairs simply by removing the former backrest. The reader will instantly realise that the ease by which "old" chairs or seats may be updated and existing chairs or seats already fitted with the backrest assembly maintained and/or refurbished will be extremely advantageous.

The support hanger part 3 is in the present instance of generally cruciform shape with an upper section having a form substantially similar to a good quality coat hanger, with a medial upper neck or collar portion 4 merging into opposite laterally projecting wing portions 5 for receiving and supporting the shoulder portions of a jacket or like garment (not shown); and with a lower or depending medial support portion 6, preferably integrally formed therewith in a plastics moulded construction. In an alternative fabricated construction the medial support depending portion 6 can be of fabricated sheet metal or metal tube or bar form, and on the upper part of which the hanger portion 4,5 is mounted.

The medial/upper rear surface part of the support hanger part 3 is preferably provided with a finger grip recess 7 to facilitate movement between the first stored and second usable positions, particularly for the preferred arrangement with the support hanger part 3 snugly fitting in the provided recess 2 and requiring to be pulled outwardly and upwardly relative thereto; and the support hanger part 3 can be mounted for pivoting movement in a vertical plane between the two positions such as by the provision of a pair of upper and lower support arms or link members 8 and 9 medially positioned in alignment one above the other and hingeably connected between the forward side of the support hanger part 3 and the outer rear face of the base 2*a* of the recess 2.

Figure 4:
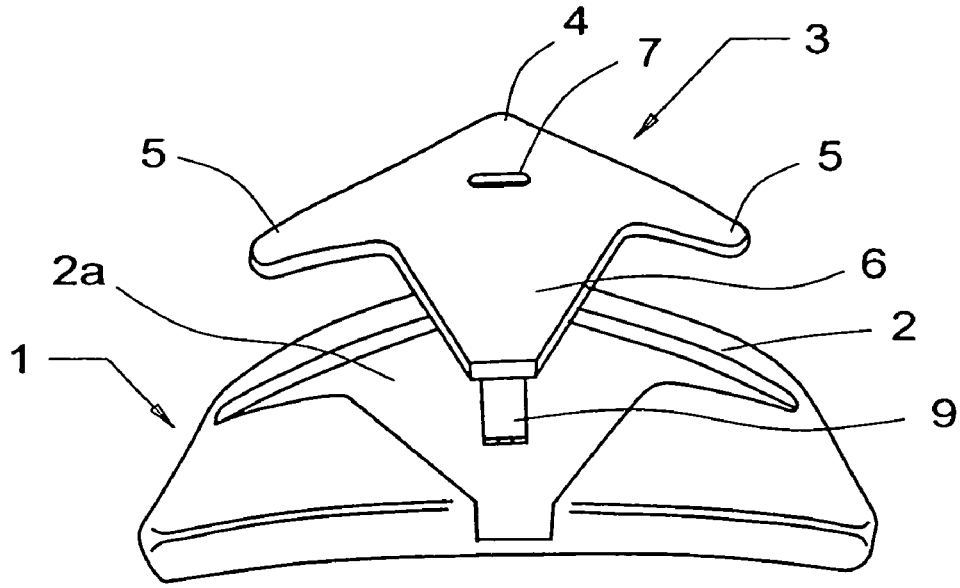
FIG. 4 is a perspective view from the lower rear side of the backrest and garment support hanger assembly, removed from the seat or chair as shown in the second projecting position.
Figure 3:
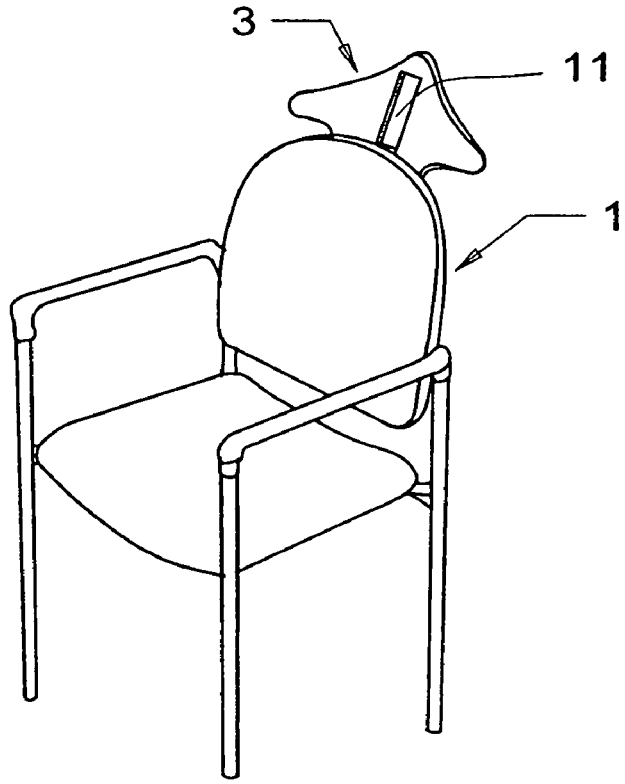
FIG. 3 is a front perspective view of the seat or chair with garment support hanger in the second elevated and projecting position.
Figure 5:
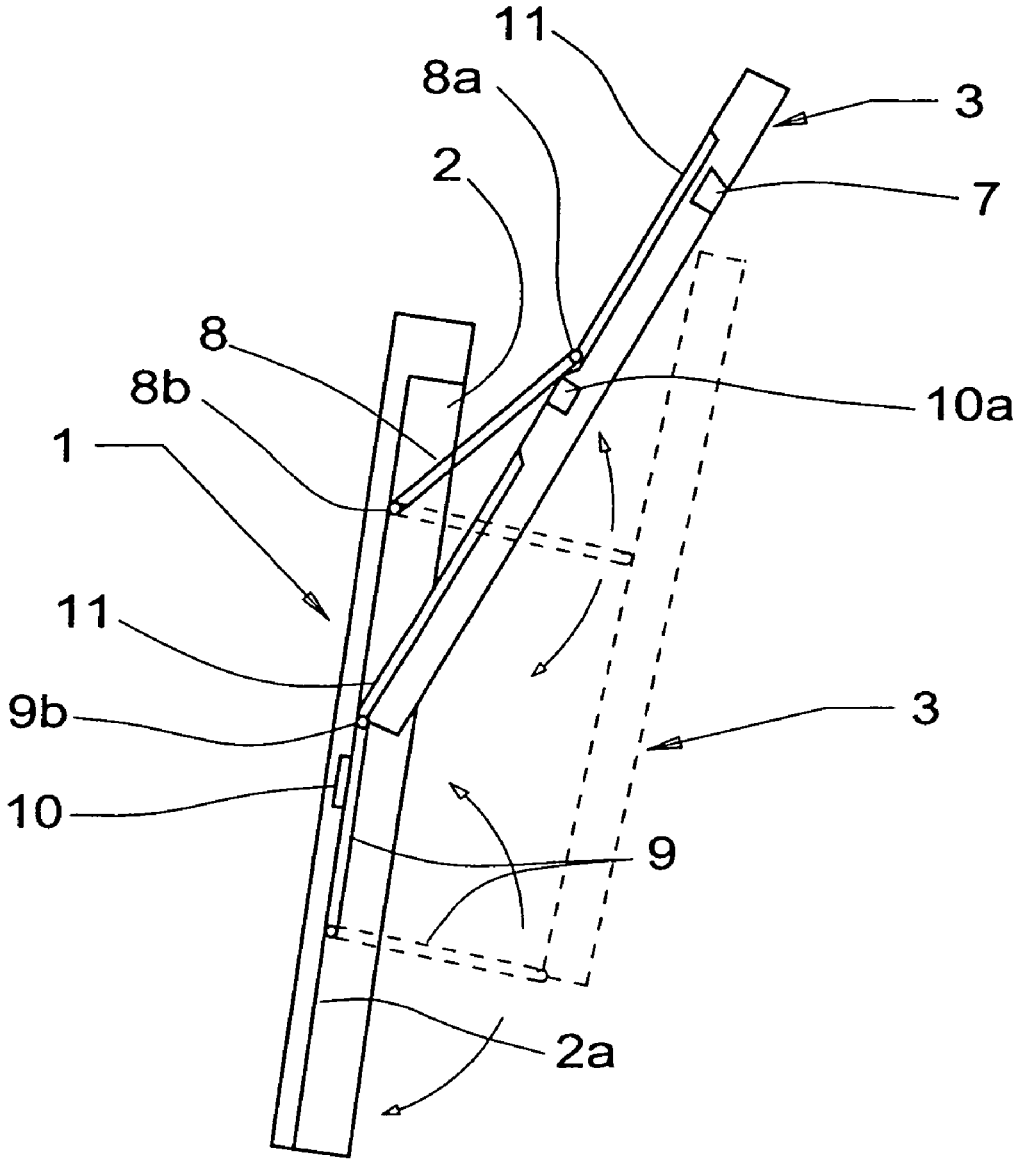
FIG. 5 is a sectional side view more particularly illustrating the construction and operation of the combination seat backrest and garment support hanger assembly

In the illustrated arrangement shown more particularly in FIGS. 4 and 5 of the drawings, the two link members 8 and 9 are of similar flat metal strap form each having their opposite end parts provided with a hinge connection (8*a*, 8*b* and 9*a*, 9*b*) defining a horizontal pivot axis; so that a parallel or substantially parallel linkage arrangement is provided and enables the support hanger part 3 to be suspended in the first stored position within the recess 2 and with the link members 8,9 depending from their inner hinge connections 8*b*,9*b* with the recess base 2*a* and lying substantially flat between the recess base 2*a* and the support hanger part 3. A user can then take hold of the rear finger grip recess 7 and pull the support hanger part 3 rearwardly outwardly and then upwardly towards the elevated upwardly projecting second position; and on reaching the upper maximum travel permitted by the parallel linkage (link members 8,9), a slight inward or forward movement of the lower end part of the support hanger part 3 to incline such part 3 will take the hinge connection 9*a* of the lower link member 9 'over-centre' of the parallel link movement to enable the lower end of the support arm portion 6 to abut the recess base 2*a*, with the lower strap link 9 extending upwardly from hinge connection 9*b* and lying flat against the recess base 2*a* to hold the support hanger part 3 against dropping downwardly from the second position, the upper strap link 8 remaining rearwardly and upwardly inclined to serve as a tie for holding the upper portion 4,5 of the support hanger part 3 in the garment supporting second position. The lower link member 9 can be assisted in remaining in the indicated upwardly extending support position by any suitable releasable catch means; and in one arrangement a magnetic catch means is provided with a magnet 10 inserted in a medial recess in the recess base 2*a* and strategically positioned to align with and be engaged by the metal lower link member 9 when in the second support position. The same magnet 10 can be dual purpose and also positioned for magnetic engagement by the upper metal link member 8, or alternatively a second alignable magnet 10*a* inserted medially of the hanger support 3, when the support hanger part 3 is no longer required to be used and is returned by downward hinging movement to the first stored or stowed position locating in the backrest recess 2, with the link members 8 and 9 depending from their inner hinge connections 8*b*, 9*b* and lying flat against the recess base 2*a* the support hanger part 3 being thus released held in the stowed position against outward movement as may be otherwise occur with chair movement, and gravitational forces in the case of the backrest 3 being inclined rearwardly as is usually preferred. Other releasable catch means can of course be provided, but the aforementioned single magnet catch means is a simple effective and economic arrangement.

To assist in providing a slim line construction the hanger part 3 is preferably provided with a vertically disposed longitudinal medial slot(s) or recess(es) 11 of a width enabling clearance fit of the upper and lower link members 8,9 therein when the hanger part 3 locates in the first stored position—the outer hinge connections 8*a* and 9*a* being fitted within such slot(s) or recess(es) 11.

Other means for mounting and supporting the support hanger part 3 for movement between the first stored and second usable positions can be provided; and it is envisaged for example that where elevation of the support hanger part 3 is not necessary for floor clearance by a supported jacket or like garment (eg as in the case of a high backed chair), the lower support part 6 and connecting parallel link members 8,9 can be dispensed with and the support hanger part 3 can have a substantially straight lower edge portion which is directly hingedly connected to the backrest, so that the upper part incorporating the neck/collar 4 and shoulder wing portions 5 is simply pulled outwardly or rearwardly from the first stored/stowed position to the second usable position. Restricted movement hinge means and/or an upper flexible or hinged tie member extending between the backrest recess base 2*a* and inner forward side of the support hanger part 3, can be provided to hold the hanger part 3 in the stored or stowed position within its recess 2.

A further alternative arrangement providing for an elevated second position envisages mounting of the upper part 4,5 of the hanger part 3 on a medial depending rod or bar which is slidably located in a supporting guide part mounted on or incorporated in the backrest 1; thus enabling the hanger part 3 to be slid upwardly or downwardly between the two positions. Two spaced depending rod or bar supports and mating supporting guide parts can be alternatively provided.

For non-stackable existing chair constructions and/or where the constructions do not conveniently permit detachment of the existing backrest and replacement by a combination backrest and garment support in accordance with the invention; it is envisaged that the combination assembly of the invention can be arranged for fitment such as by screws to the existing chair backrest. Also, where the invention is applied to such as a hotel or other bedroom chair and clothes hanging space is at a premium, the rear lower side of the garment support hanger part 3 can be provided with such as a trouser hanger bar and/or hook or clip means for skirt or trouser support.

Figure 6:
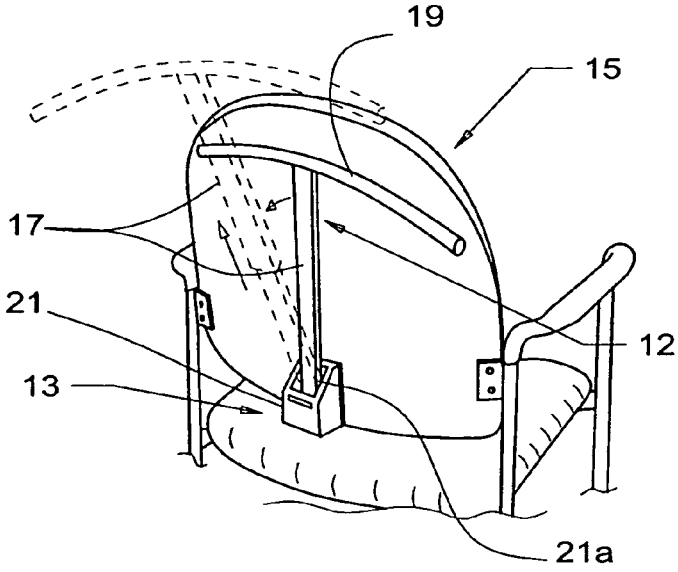
FIG. 6 is a rear perspective view illustrating one example of an alternative simpler form of independently constructed garment hanger assembly fitted to a typical existing seat backrest which is shown only in part.
Figure 8:
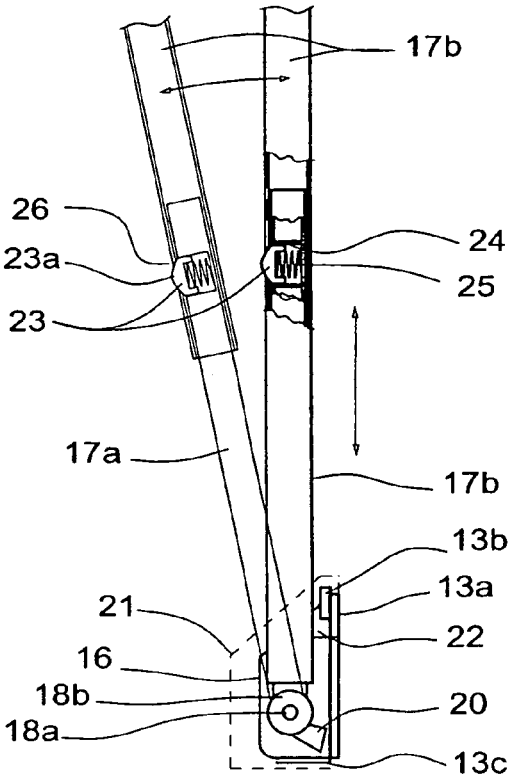
FIGS. 7 & 8 are rear and side part broken views more particularly illustrating the construction and operation of the garment hanger support and mounting parts.
Figure 7:
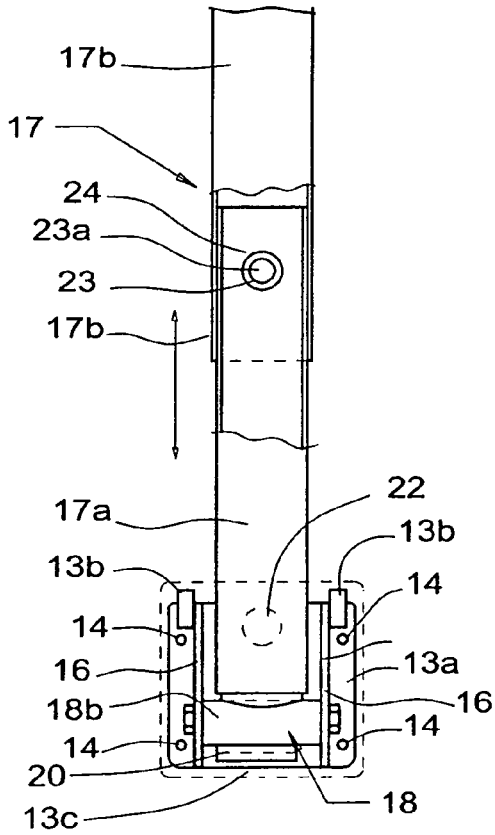

Referring now to FIGS. 6,7 and 8 of the drawings, in one alternative form of the invention there is provided an independently constructed garment support hanger unit (generally indicated by the arrow 12) which can be factory fitted to the backrest parts of complete new chairs or to new replacement chair backs intended for fitment to existing chairs, or which can be sold independently for retro-fitment to the existing backrest parts of existing chairs.

The hanger unit 12 includes a strong base mounting 13 which in this instance comprises a squared mounting plate 13*a* provided with clearance holes 14 for receiving mounting screws bolts or like fasteners and securing the unit 12 to the medial lower rear part of a chair backrest 15; and a-pair of spaced vertical flange parts 16 which project rearwardly from the mounting plate 13*a* to have a hanger support arm 17 project upwardly from a lower end pivotal connection 18 with the flange parts 16. The support arm being movable about a horizontal pivot axis 18*a* parallel with the mounting plate 13*a* and associated portion of the chair backrest 15, for movement of the support arm 17 and upper garment hanger 19 thereon between a first inner stowed position (as shown in full line in FIGS. 6 and 8), and a second outwardly inclined projecting position ready for use, and vice-versa. The pivot connection 18 can be simply a transverse tubular sleeve 18*b* fixedly secured (eg by welding to the lower end of the support arm 17 located about a bolt shank or pivot pin (defining the pivot axis 18*a*) secured to and extending between the mounting flange parts 16; and a limiting stop member 20 is secured to and projects inwardly below the sleeve 18*b* to abut the mounting plate 13*a* and limit the outward pivoting movement of the support arm 17. The base mounting 13 may include a detachable cover part 21 to conceal the mounting plate 13*a*, flanges 16, pivot connection 18 and limiting stop 20; and such cover part 21, which has an upper squared clearance aperture 21*a* through which the support arm 17 projects, may be securable in position by having its upper inner edge part 21*b* arranged for hooked engagement over upper projections 13*b* of the mounting plate 13*a* and a base wall 13*c* which locates under a base projection or flange 13*c* of the mounting 13 for securing thereto, such as by screws or a snap-fit arrangement. Other base mounting 13 and concealing cover/housing arrangements can of course be employed.

Means are preferably provided to normally retain the support arm 17 and hanger 19 in the inner stowed position adjacent the rear face of the chair backrest 15, when not required for garment support; and in one arrangement, with the support arms 17 being constructed from steel, a magnet 22 is fixedly mounted on the upper rear face part of the mounting plate 13*a* so that support arm 17 can abut against the magnet 22(for detachable retention thereby) when in the inner pivoted position. A spring catch or other releasable retaining means can alternatively be employed, or it is envisaged that the support arm 17 can be spring biased towards the inner stowed position and held in the outer position only when the hanger 19 thereof is supporting a jacket or like garment the weight of the garment overcoming the spring bias.

In the illustrated form of FIG. 6, the hanger 19 is of simple curved tube form, and may be curved inwardly to conform with a curved chair backrest 15 as well as downward either side of the support arm 17 in typical simple garment hanger form; but of course a more particularly shaped hanger 19 with a medial shaped neck support part can be provided (eg in the manner similar to that described with reference to FIGS. 1 to 4. Likewise a simpler form of hanger or garment support part can be employed in the earlier described recessed fitting arrangement.

Preferably, the hanger 19 is arranged to be elevated relative to the chair backrest 15 when the unit 12 is in use for garment support, with the support arm 17 pivoted outwardly about its pivot connection 18; and the support arm 17 can be of two part telescopic construction with releasable catch or latch means to hold the support arm 17 in the extended position.

In the illustrated form the support arm 17 is of flattened tubular steel construction with a first smaller cross section inner lower part 17*a* secured to and extending upwardly from the pivot connection 18, and a larger cross section upper and outer part 17*b* which is of complementary cross sectional shape to the inner lower part 17*a* so as to be slidably located thereover for upward extension and downward retraction relative thereto. The garment hanger 19 is mounted on the upper end of the outer part 17*b*; and the releasable catch means comprises an outwardly spring biased button 23 located as a close sliding fit within an aperture 24 in an upper part of the rear outer wall of the support arm lower part 17*a*, with an inner compression spring 25 providing the outward spring bias.

The lower end part of the rear wall of the support arm upper and outer part 17*b* is provided with a smaller aperture 26 alignable with the button 23 and within which a rounded (or bevel edged) projecting portion 23*a* of the button can locate under the spring bias when the support arm 17 is extended and to thus hold the support arm 17 in the extended position. For retraction and stowing of the support arm 17 when the unit 12 is not required to support a garment, inward thumb pressure on the button projection 23*a* against the spring bias will release such projection 23*a* from its engagement in aperture 25 to enable the support arm outer part 17*b* to be slid downwardly over and relative to the support arm lower part 17*a*. Other releasable catch means can of course be employed.

Some preferred aspects of the invention have been described and illustrated by way of example, but it will be appreciated that other variations of and modifications to the invention can take place without departing therefrom.

Throughout the description and claims of this specification the word "comprise" and variations of that word, such as "comprises" and "comprising", are not intended to exclude other additives, components, integers or steps.

We claim:

1. A support hanger assembly adapted to be fitted to a backrest of a seat, and wherein the backrest comprises a rear face and a forward face, the forward face against which a user's back can rest when seated, the assembly comprising a support means movable between a first stowed non-usable position within the rear face of the backrest and, a second usable position projecting outwards and upwards from the backrest in order to support a garment when in use, and further wherein the support hanger means comprises a plurality of linking arms medially positioned substantially in alignment one above the other and, a hinge means, hingeably connecting said linking arms between the forward face of the support hanger assembly and the outer rear face of a base recessed within the rear face of a seat or chair backrest and wherein the linking arms are adapted to work co-operatively to enable the support hanger to move-between the first stowed non-usable position and the second usable position.

2. A seat backrest assembly arranged for fitment to the rear face of a backrest wherein said backrest comprises a forward face of a seat against which a user's back can rest when seated, the backrest assembly comprising a rear face incorporating a support hanger adapted to be movable between a first stowed non-usable position and a second usable position projecting outwards and upwards from the backrest and wherein the assembly enables a garment to be positioned and supported thereon, and wherein the rear face of the seat backrest is recessed to enable a support hanger to be housed within said backrest recess when the support hanger is in said first stowed non-usable position and the support means hanger comprises: a plurality of linking arms medially positioned substantially in alignment one above the other and a hinge means, hingeably connecting said linking arms between the forward face of the support hanger and the outer rear face of a base recessed within the rear face of the backrest and wherein the linking arms are adapted to work co-operatively to enable support hanger to move between the first stowed non-usable position and the second usable position.

3. The seat backrest assembly according to claim 2 wherein the support hanger is configured to provide form-fitting support across and between the shoulder portions of a garment and, in use, is adapted to maintain the garment's shape.

4. The seat backrest assembly according to claim 3 comprising a medial support portion.

5. The seat backrest assembly according to claim 4 wherein the medial support portion comprises an upper projecting shaped neck portion and a plurality of opposite laterally projecting wing portions co-operating therewith, the wing portions adapted to support the shoulder portions of a garment.

6. The seat backrest assembly according to claim 5 wherein the upper projecting neck portion is telescopically maneuverable.

7. The seat backrest assembly according to 5 wherein the medial support portion the neck portion is absent.

8. The seat backrest assembly according claim 7 wherein the backrest recess comfort in depth and shape to the thickness and shape of the support hanger.

9. The seat backrest assembly according to claim 7 wherein the backrest recess conforms in depth and shape to the thickness and shape of the support hanger and wherein the support hanger portion is configured to lie substantially flush with the rear face of the recessed seat backrest when in the stowed non-usable position.

10. The seat backrest assembly according to claim 9 wherein the support hanger and mounting arrangement therefore is adapted such that when in use the first stowed non-usable position the support hanger lies adjacent with the rear face of the backrest.

11. The seat backrest assembly according to claim 10 wherein the support hanger is located, when in the second usable position, in a raised projecting altitude relative to the backrest to support a garment in an elevated position sufficient to allow the lower edge portions of said garment to remain clear of the floor on which the seat is located.

12. The seat backrest assembly comprising the seat according to claim 11.

13. A seat comprising the support hanger assembly according to claim 1.

* * * * *

UNITED STATES PATENT AND TRADEMARK OFFICE

CERTIFICATE OF CORRECTION

PATENT NO. : 7,063,381 B2
APPLICATION NO. : 10/501977
DATED : July 15, 2004
INVENTOR(S) : Patrick Joseph Scahill and Stephen James Garlick It is certified that error appears in the above-identified patent and that said Letters Patent is hereby corrected as shown below:

Column 3, line 3, “lice” should be changed to --like--.

Column 9, line 1, after the word “to” add the word --claim--.

Signed and Sealed this

Fourteenth Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 7,063,381 B2
APPLICATION NO. : 10/501977
DATED : June 20, 2006
INVENTOR(S) : Patrick Joseph Scahill and Stephen James Garlick It is certified that error appears in the above-identified patent and that said Letters Patent is hereby corrected as shown below:

Column 3, line 3, “lice” should be changed to --like--.

Column 9, line 1, after the word “to” add the word --claim--.

This certificate supersedes Certificate of Correction issued November 14, 2006.

Signed and Sealed this

Second Day of January, 2007

JON W. DUDAS
*Director of the United States Patent and Trademark Office*